US005361548A

United States Patent [19]

Kuehn

[11] Patent Number: 5,361,548

[45] Date of Patent: Nov. 8, 1994

[54] MULTI-STATION ABRADING APPARATUS

[75] Inventor: Udo Kuehn, Onsted, Mich.

[73] Assignee: B&U Corporation, Adrian, Mich.

[21] Appl. No.: 917,941

[22] Filed: Jul. 24, 1992

[51] Int. Cl.[5] ..... B24C 3/32

[52] U.S. Cl. ..... 451/76; 451/81; 451/336; 451/339; 451/402

[58] Field of Search ..... 51/410, 411, 418, 426, 51/428, 431, 319, 326, 215 JE, 215 E, 216 R, 216 T, 216 A, 236, 237

[56] References Cited

U.S. PATENT DOCUMENTS 2,073,184 3/1937 Schweitzer .
2,337,048 12/1943 Huyett et al. ..... 51/431
2,344,476 3/1944 Turnbull .
2,465,360 3/1949 Dill ..... 51/431
2,640,584 6/1953 Robb et al. .
2,952,567 7/1960 Nordquist et al. .
3,813,817 6/1974 Häberlin ..... 51/431
4,723,377 2/1988 Watts ..... 51/426
4,793,103 12/1988 Baumgart ..... 51/426

*Primary Examiner*—M. Rachuba
*Attorney, Agent, or Firm*—Harness, Dickey & Pierce

[57] ABSTRACT

An apparatus for abrading articles. The abrading apparatus includes a number of abrading stations located adjacent to one another so that as an article is abraded at one station, a previously abraded article will be redundantly abraded at the adjacent station. The apparatus further includes fixtures having non-clamping holders which gravitationally retain the articles. The fixtures also allow the articles to be manipulated about an axis so that all surfaces of the articles can be abraded and so that abrasive materials which have collected in surface irregularities of the articles can be emptied therefrom.

13 Claims, 3 Drawing Sheets

MULTI-STATION ABRADING APPARATUS

BACKGROUND AND SUMMARY OF THE INVENTION

This invention relates generally to article abrading and more particularly to a multi-station shot blasting machine.

During the production of various metal articles, such as engine blocks, it is necessary to clean the article so as to remove scale, encrusted sand, rough metal burrs, flash and other remnants from the formation process.

Previous shot blasting machines have exhibited various limitations. One limitation arises because the articles themselves often have cavities, depressions, openings, corners and other surface irregularities. With articles of this type, the shot particles tend to collect within the various internal cavities and surface irregularities thus requiring that an additional production step, to remove the particles, be provided.

Another limitation of prior shot blasting machines is that they do not readily permit exposure and cleaning of all article surfaces, including those of the internal cavities. Typically, these machines employ holders which grip or clamp directly onto the surfaces of the article which are to be cleaned. These clamping-type holders prevent the surfaces of the article immediately thereunder from being cleaned. Another limitation associated with the clamping-type holders is that being within the harsh environment of the shot blaststream, these holders are subject to frequent mechanical malfunctioning. Also, to ensure that all sides of the article are abraded, the abrasive material must be applied from numerous blast wheels located around the article. Another limitation with prior machines is that often, the articles are not sufficiently cleaned by a single cleaning cycle.

With these and other limitations in mind, the present invention seeks to provide an apparatus which cleans all the surfaces of the article, including those associated with surface irregularities and internal cavities.

In furthering this object, the invention seeks to ensure that the article is fully cleaned after one full cycle through the abrading apparatus while reducing the number of blast wheels used to discharge the shot.

Another object of the present invention is to eliminate the need for a separate production step to remove any shot which has collected in the surface irregularities and internal cavities of the article.

In achieving the above objects, the invention provides for a shot blast machine having a multiple number of blast wheel stations or locations. The stations are adjacently positioned relative to one another to allow for one of the articles to be primarily shot blasted while the adjacent article, having already been primarily shot blasted, is incidently or redundantly cleaned by the shot being projected against the primary article.

The articles are successively advanced through the blast stations by an endless conveyor having fixtures for individually carrying the articles. The articles are held by gravity in inclined holders which support the articles during blast cleaning such that no clamp-type gripping of the articles is required. The holders are mounted to the fixtures so that the articles may be manipulated as they are transferred through the blast stations. The combination of the non-clamping holder and manipulation of the article allows for all the surfaces of the articles to be exposed to the abrading material and allows for a decreased number of blast wheels. The manipulation of the article also causes any abrading material which has accumulated within the surface irregularities of the article to be removed or dumped therefrom.

The result of the above invention is a simplified abrading apparatus that ensures efficient and complete cleaning of all of the surfaces of the article, while eliminating a production step for removing deposits of abrading material from the cleaned article.

Additional benefits and advantages of the present invention will become apparent to those skilled in the art to which this invention relates from the subsequent description of the preferred embodiment and the appended claims, taken in conjunction with the accompanying drawings.

DETAILED DESCRIPTION OF THE PREFERRED EMBODIMENT

Figure 1:
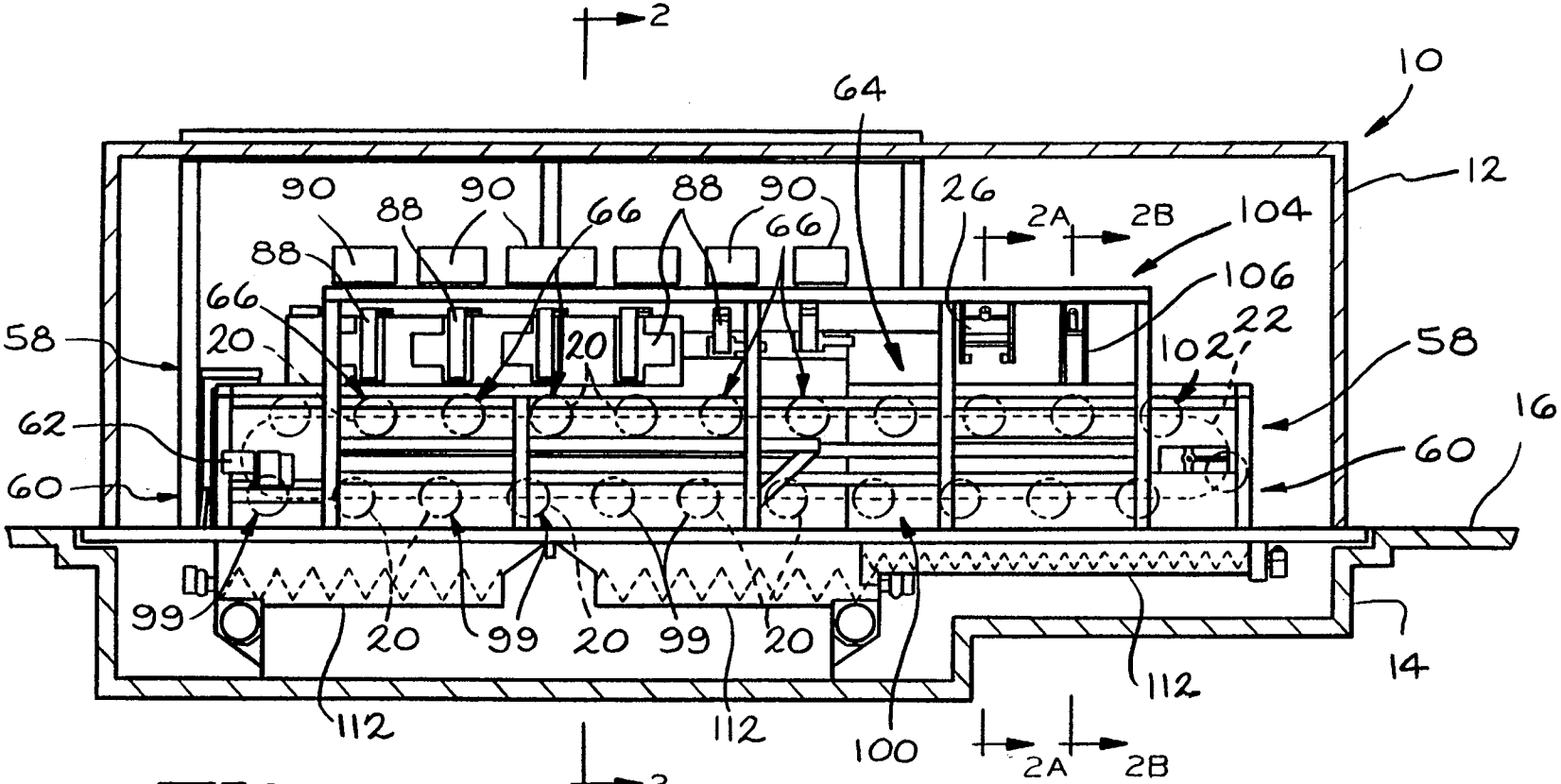
FIG. 1 is a side elevational view of a multi-station abrading apparatus embodying the principles of the present invention.

With reference to the drawing, a shot blasting apparatus embodying the principles of the present invention is illustrated in FIG. 1 and generally designated at 10. The working aspects of the apparatus 10 are illustrated as being housed within an enclosure 12 and a well 14. In the illustrated embodiment, the well 14 is shown as extending below a floor 16 of the facility in which the apparatus 10 is being used. However, it is readily apparent that the entire apparatus may be provided above the floor 16 if so desired.

Figure 2B:
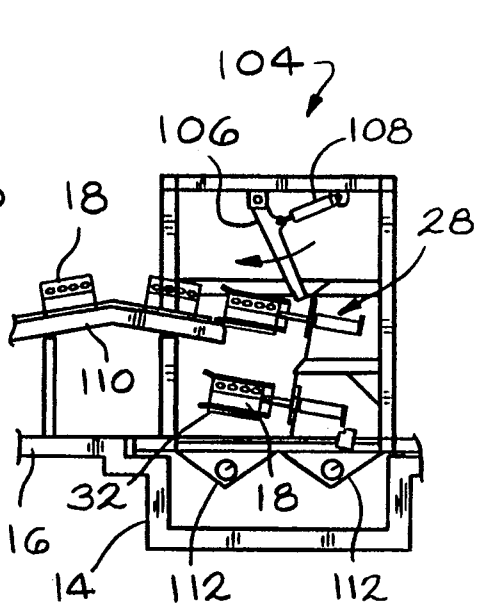
FIG. 2B is a sectional view taken substantially along line 2B—2B in FIG. 1 showing the unloading station of the present invention.
Figure 2:
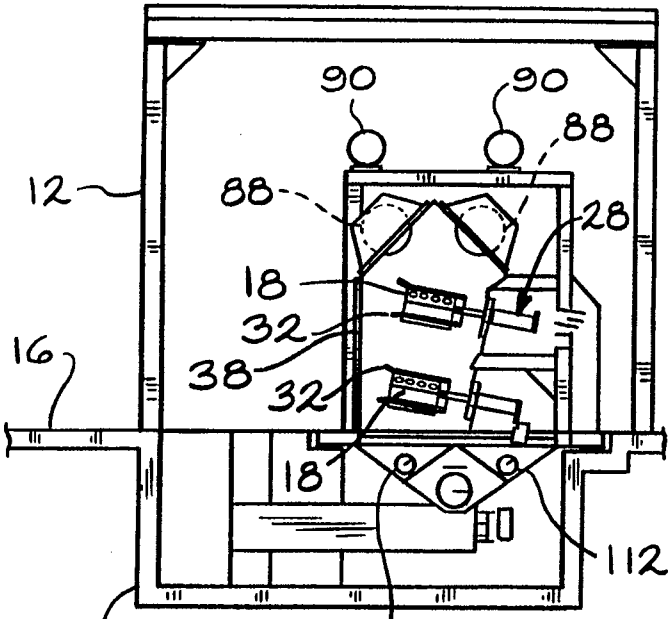
FIG. 2 is a sectional view taken substantially along line 2—2 in FIG. 1 illustrating the relative positions of adjacent blast stations.
Figure 3:
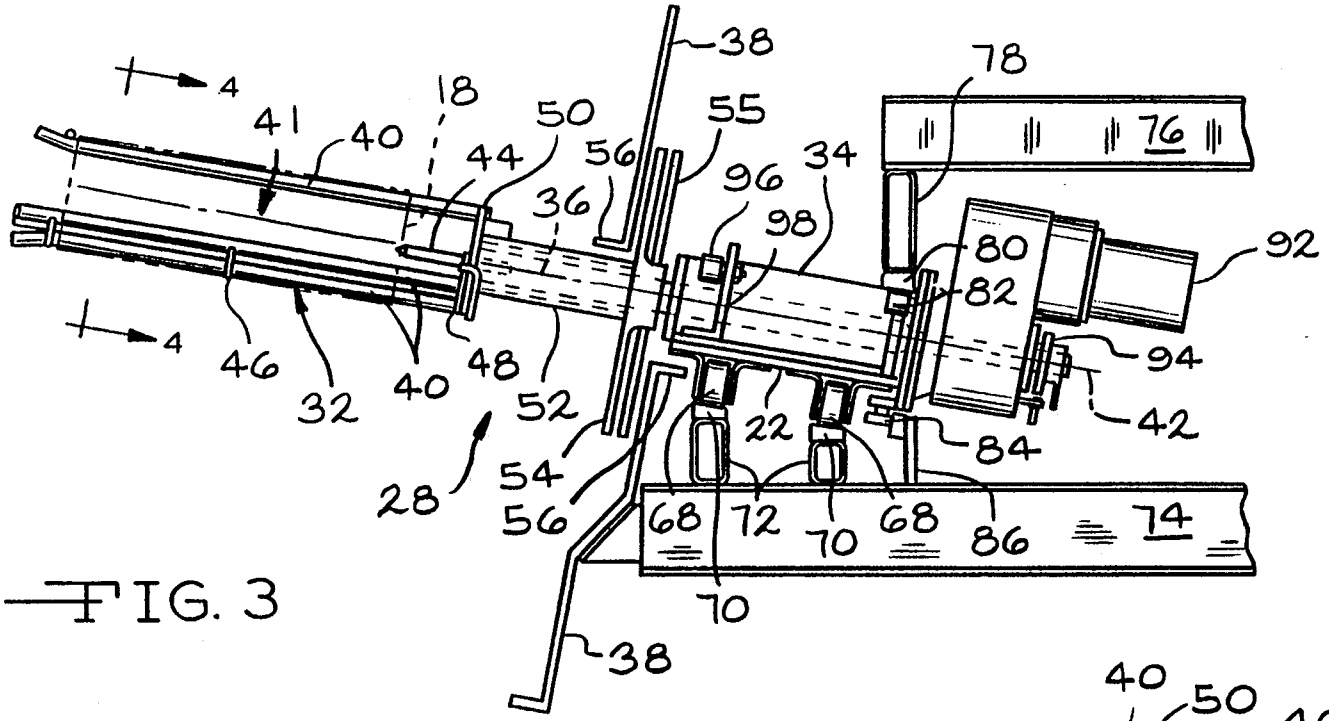
FIG. 3 is an enlarged side elevational view of the fixture used for holding and manipulating the article during abrading in the apparatus of the present invention.
Figure 4:
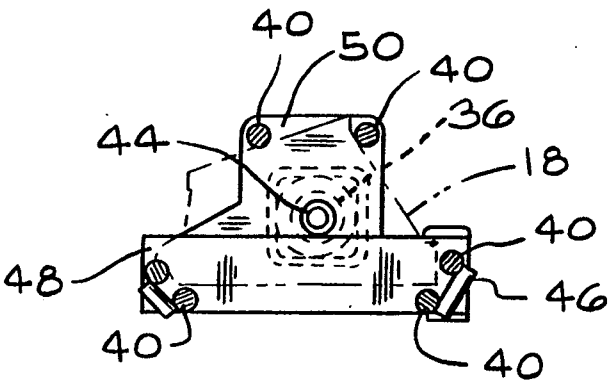
FIG. 4 is an enlarged sectional view of the article holding fixture as seen from substantially the line 4—4 in FIG. 3.

In the present invention, a continuous supply of articles such as engine blocks 18 are cleaned or abraded by being successively transported through a number of shot blast stations or locations. While the apparatus 10 of the present invention is specifically designed for use with articles 18 such as engine blocks, as illustrated in FIGS. 2 and 3, the present invention is not intended to be interpreted as being limited thereto. The positioning of an article 18 at a station of the present invention is generally illustrated by a circle, for clarity, some of which are designed at 20 in FIG. 1. An endless conveyor 22 is used to transfer the articles 18 through the various stations.

Figure 2A:
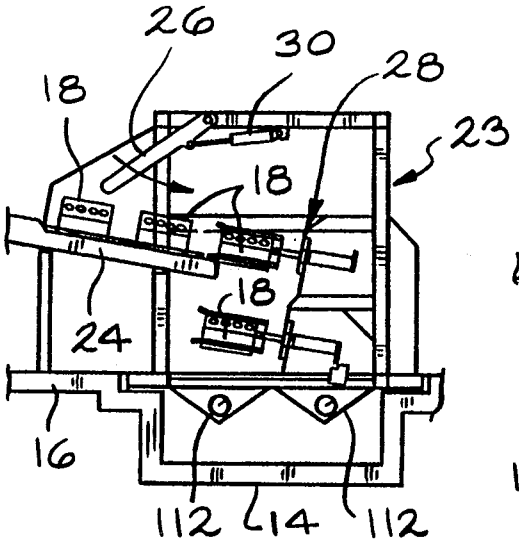
FIG. 2A is a sectional view taken substantially along line 2A—2A in FIG. 1 showing the loading of articles into the present invention.

Referring now to FIGS. 1 and 2A, at a loading station 23, articles 18 which are to be cleaned are received from a loading conveyor 24 and transferred by a loading arm 26 into a fixture or manipulator 28 oriented to receive the article 18. The loading arm 26 is rotated by a hydraulic cylinder 30 to slide the article 18 into a holder 32 of the manipulator 28. Alternative loading mechanisms could readily be utilized.

The manipulator 28 may be best described with reference to FIG. 3. The manipulator 28 includes a central body 34 through which a spindle 36 is journaled for rotation. The manipulator 28 orients the spindle 36 at an incline of about 10° up from horizontal. Depending on the article being processed, alternative inclinations may be used. The elevated end of the spindle 36 extends into a blast cabinet 38 and has the holder 32 mounted thereon.

The holder 32 itself includes a multiple number of arms 40, six in the illustrated embodiment, which are attached to the spindle 36 and which extend in a generally parallel fashion to the spindle 36 and one another. The arms 40 are spaced apart so as to generally define a receiving space 41 for the engine block 18. To promote the introduction of the engine block 18 into the receiving space 41 at the loading station 23, the inboard end 43 of each arm 40 is divergently flared from an axis 42 generally defined by the spindle 36. When an engine block 18 is received within the holder 32, the engine block 18 engages a stop pin 44 that ensures exposure of the end of the engine block 18. To assist in supporting the weight of the engine block 18, the holder 32 includes reinforcing brackets 46, 48 and 50.

The holder 32 is interchangably mounted in the manipulator 28 so that alternatively configured holders can be readily exchanged to promote quick product change in the apparatus 10.

Within the blast cabinet 38, the spindle 36 is protected by a sheath 52. At the outboard end of the sheath 52 is a radially extending disc 54 and a liner or curtain 55, which cooperate to form a labyrinth-type seal preventing abrasive materials, as further discussed below, from being expelled through a spindle slot 56 defined along the wall of the blast cabinet 38.

The body 34 of the manipulator 28 is mounted to the endless conveyor 22. As seen in FIG. 1, a motor 62 induces movement of the conveyor 22 so as to transport the engine blocks 18, first along an upper series of abrading stations and subsequently along a lower series of abrading stations. The upper and lower series of abrading stations are respectively generally designated at 58 and 60. As is more fully described below, primary abrading occurs along the upper series of abrading stations 58 while redundant abrading occurs along the lower series of abrading stations 60. Depending on the particular articles 18 being processed, redundant abrading along the lower series of abrading stations 60 may be prevented and, as also more fully discussed below, manipulation of the articles 18 performed only to remove abrading materials and other debris from the surface irregularities and internal cavities of the article 18.

As the conveyor 22 is advanced, the engine blocks 18 are transported from the loading station 23 into an entrance vestibule 64 and then to the first of the series of upper abrading stations 58.

Mounted to the body 34 of the manipulator 28, beneath the conveyor 22 when the manipulator 28 is at the upper abrading stations 58, are a pair of rollers 68 which travel in tracks 70 supported by risers 72 and a support frame 74. To maintain a constant inclined orientation of the spindle 36, the risers 72 are provided with varying heights and the conveyor 22 is operated about a axis which does not correspond to vertical. The manipulator 28 shown in FIG. 3 is illustrated as being at one of the upper stations 58.

Because of the weight of the engine block 18, precautions must be taken to prevent upsetting or destablizing of the manipulator 28. To this end, an upper support frame 56 is provided with a downwardly extending riser 78 having a track 80 mounted thereto. An outboard roller 82, mounted to the body 34, engages the track 80 to prevent pivoting of the manipulator 28 about the inboardmost roller 68 under the weight of the engine block 18. Additionally, the manipulator 28 includes an alignment roller 84 positioned in engagement with a guide 86 extending upwardly from the support frame 74. The alignment roller 84 and guide 86 prevent transverse movement, in the outboard direction, of the manipulator 28 and disengagement of the rollers 68 from the tracks 70. At each of the upper stations 58, the engine block 18 is impacted upon by an abrasive material, preferably steel shot, being projected generally downwardly from blast wheels 88 driven by motors 90. For each station 58, two wheels 88 are oriented so that the shot impacts both the ends and the upward surfaces of the engine block 18. To further ensure that the entire engine block 18, including its lower surfaces, is abraded and cleaned, the manipulator 28 is capable of being rotated or manipulated about the axis 42 of the spindle 36.

Rotation of the engine block 18 about the axis 42 allows the unexposed areas, such as the lower surfaces and cavity surfaces, to be impacted by the blasting shot. Rotation is accomplished through use of a stepper or other motor 92 coupled to the spindle 36, thereby rotating holder 32 causing a tumbling action or movement to the engine block 18, whereby substantially all surfaces of the engine block 18 are exposed to the blasting shot including non-exposed surfaces of the engine block 18 previously contacting portions of the holder 32. Depending upon the specific application of the abrading apparatus 10, it may be desirable to continuously rotate the spindle 36 and the engine block 18; to periodically rotate the engine block 18 while at each individual abrading stations 58; to expose specific areas or surfaces of the article 18 to the shot blast for extended periods to time or to advance the rotation of the engine blocks 18 at each successive abrading station 66. Also depending upon the setup chosen for the abrading apparatus 10, the manipulators 28 may be individually provided with stepper motors 92 or may be successively coupled to a stepper motor at each abrading station 58 and engaged by gears 94. A chain engaging a gear 94, located on the outboardmost end of each fixture 23, may be used in conjunction with a single stepper motor to continuously rotate all or some of the manipulators 28, particularly during emptying of abrading materials, shot and other debris from the articles 18. Programmable controls (not shown), used in connection with motors 92, may be used to provide these features.

At each end of the conveyor 22, the manipulators 28 are inverted as they are transferred from the upper stations 58 to the lower stations 60. For this reason, the manipulators 28 are provided with an additional roller 96 supported by bracket 98 attached to the body 34. Once inverted, rollers 82 and 96 will support the manipulator 28, roller 68 will assist in preventing destabilization of the manipulator 28 under the weight of the engine block 18, and roller 84 will continue to maintain proper alignment of the manipulator 28 through a comparable setup as shown in FIG. 3.

As the engine blocks 18 are transferred to the lower stations 60, the orientation of the spindle 36 about the axis 42 is maintained. This allows the engine block 18 to be gravitationally maintained within the receiving space 41 of the holder 32. Thus, complex gripping or attachment mechanisms need not be incorporated into the present invention.

The lower stations 60 are positioned to generally vertically correspond with the upper stations 58. In this manner, as shot is being impelled against the engine blocks 18 at the upper stations 58, the engine blocks 18 at the lower stations 60 will be redundantly impacted by the shot further enhancing cleaning and abrading.

The engine blocks 18 are moved along the lower stations 60 until exiting the blast cabinet 38 through an exit vestibule 100. At this point, further manipulation of the engine blocks 18 by the stepper motor 92 will cause for any shot, or other debris, which has accumulated in the various surface irregularities and cavities of the engine block 18 to be effectively emptied therefrom. Airblast stations could also be provided to aid in emptying the shot.

At the opposing end of the conveyor 22, the engine block 18 is transferred up to a station 102 where it is inspected and then transferred to an unloading station 104. As seen in FIG. 2B, an arm 106 is actuated by a hydraulic cylinder 108 at the unloading station 104 to push the engine blocks 18 out of the holders 32 onto an unloading conveyor 110. Alternative unloading mechanisms could readily be employed.

In the well 14, the shot blast apparatus 10 is provided with a number of screw conveyors 112 which reclaim the used shot and direct it toward an elevator (not shown) so that it may be fed into a hopper (not shown) and reused.

While the above description constitutes the preferred embodiment of the present invention, it will be appreciated that the invention is susceptible to modification, variation and change without departing from the proper scope and fair meaning of the accompanying claims.

What is claimed is:

1. A shot blast machine for abrasively cleaning a plurality of articles comprising:

a plurality of shot blast stations adjacently positioned relative to one another, said shot blast stations including abrading means for abrading articles to be cleaned, said abrading means providing shot to shot blast an article at said shot blast stations, endless conveyor means for conveying said articles to said blast stations, a plurality of fixtures mounted on said endless conveyor means for movement therewith, an article carried on each fixture, each fixture including a non-clamping holder, each article being freely and gravitationally contained in said non-clamping holder, and manipulation means operatively connected between said holders and said fixtures for manipulating and rotating said holders and associated freely contained articles to expose substantially all surfaces of said articles to said abrading means including non-exposed surfaces of articles previously contacting portions of said holders.

2. Apparatus as set forth in claim 1 wherein said abrading means performs primary abrading of an article at one of said shot blast stations while simultaneously performing redundant abrading of another article at another of said blast stations located in a position adjacent thereto.

3. Apparatus as set forth in claim 1 wherein said shot blast stations include a plurality of upper blast stations and a plurality of lower blast stations.

4. Apparatus as set forth in claim 3 wherein said upper blast stations are generally vertically aligned and positioned with respect to said lower blast stations.

5. Apparatus as set forth in claim 3 wherein said abrading means performs primary abrading of said articles at said upper abrading stations and simultaneously performs redundant abrading of said articles at said lower abrading stations.

6. Apparatus as set forth in claim 1 wherein each of said holders includes a plurality of substantially parallel arms generally defining a receiving space into which one of said articles is received.

7. Apparatus as set forth in claim 1 wherein said holders are mounted to said fixtures for manipulation and rotation about an upwardly inclined axis.

8. Apparatus as set forth in claim 7 wherein said axis is angularly oriented about an axis between five (5) and forty-five (45) degrees up from horizontal.

9. Apparatus as set forth in claim 7 wherein said axis is angularly oriented at about ten (10) degrees.

10. Apparatus as set forth in claim 1 wherein said manipulation means includes at least one motor coupled to said holders.

11. Apparatus as set forth in claim 1 wherein said manipulation means includes a plurality of motors individually coupled to said holders.

12. Apparatus as set forth in claim 1 wherein said abrading means includes at least one blower, said blower being positioned above said abrading stations and abrading material being projected from said blower at said article.

13. Apparatus as set forth in claim 1 wherein said manipulation means manipulates said articles for removing substantially all of said abrading material from said surfaces of said articles after abrading has been performed.

* * * * *